US010971064B2

(12) United States Patent
Lee et al.

(10) Patent No.: US 10,971,064 B2
(45) Date of Patent: Apr. 6, 2021

(54) DISPLAY APPARATUS

(71) Applicant: LG Display Co., Ltd., Seoul (KR)

(72) Inventors: Seyong Lee, Paju-si (KR); Sanghun Yoon, Paju-si (KR); YeaJin Hwang, Paju-si (KR)

(73) Assignee: LG DISPLAY CO., LTD., Seoul (KR)

( * ) Notice: Subject to any disclaimer, the term of this patent is extended or adjusted under 35 U.S.C. 154(b) by 0 days.

(21) Appl. No.: 16/715,999

(22) Filed: Dec. 16, 2019

(65) Prior Publication Data

US 2020/0211452 A1 Jul. 2, 2020

(30) Foreign Application Priority Data

Dec. 31, 2018 (KR) ..... 10-2018-0174088

(51) Int. Cl.
*G09G 3/325* (2016.01)
*G09G 3/3291* (2016.01)
*G09G 3/3266* (2016.01)

(52) U.S. Cl.
CPC ..... *G09G 3/325* (2013.01); *G09G 3/3266* (2013.01); *G09G 3/3291* (2013.01); *G09G 2310/0264* (2013.01)

(58) Field of Classification Search
CPC .... G09G 3/325; G09G 3/3291; G09G 3/3266; G09G 2310/0264; G09G 2310/0262; G09G 2300/0819; G09G 2300/0852; G09G 2300/0861; G09G 2310/0251; G09G 3/3233; G09G 3/3225; G09G 3/3258
See application file for complete search history.

(56) References Cited

U.S. PATENT DOCUMENTS

| | | | | |
|---|---|---|---|---|
| 7,889,160 | B2 * | 2/2011 | Yoo | G09G 3/3233 345/83 |
| 8,284,136 | B2 | 10/2012 | Kang et al. | |
| 9,099,036 | B2 * | 8/2015 | Kitazawa | G09G 3/3283 |
| 9,658,710 | B2 * | 5/2017 | Yang | G06F 3/0412 |
| 2004/0257353 | A1 * | 12/2004 | Imamura | G09G 3/3233 345/204 |

(Continued)

FOREIGN PATENT DOCUMENTS

| | | | |
|---|---|---|---|
| CN | 108847186 | A | 11/2018 |
| CN | 108877679 | A | 11/2018 |
| KR | 10-2011-0080388 | A | 7/2011 |

*Primary Examiner* — Amy Onyekaba
(74) *Attorney, Agent, or Firm* — Birch, Stewart, Kolasch & Birch, LLP

(57) ABSTRACT

A display apparatus includes a display panel including a plurality of pixels configured to display an image, each of at least one of the plurality of pixels including a pixel circuit and a light emitting device connected to the pixel circuit, wherein the pixel circuit includes a driving transistor controlling a driving current flowing at the light emitting device, a data supply transistor selectively providing a data voltage to a first node which is a source electrode of the driving transistor, a first light emitting control transistor selectively connecting the first node to a second node which is an electrode of the light emitting device, a first capacitor connected between the second node and a fourth node which is a gate electrode of the driving transistor, and a second capacitor connected between the second node and a gate electrode of the data supply transistor.

20 Claims, 8 Drawing Sheets

(56) References Cited

U.S. PATENT DOCUMENTS

2005/0083270 A1* 4/2005 Miyazawa ..... G09G 3/3233 345/76
2006/0066532 A1* 3/2006 Jeong ..... G09G 3/3233 345/76
2006/0077194 A1* 4/2006 Jeong ..... G09G 3/3233 345/204
2008/0001857 A1* 1/2008 Yoo ..... G09G 3/3233 345/76
2008/0158110 A1* 7/2008 Iida ..... G09G 3/3233 345/76
2008/0231576 A1* 9/2008 Yamamoto ..... G09G 3/3233 345/90
2009/0108763 A1* 4/2009 Han ..... G09G 3/3233 315/169.3
2009/0109150 A1* 4/2009 Han ..... G09G 3/3266 345/82
2009/0160743 A1* 6/2009 Tomida ..... G09G 3/3233 345/80
2010/0289793 A1* 11/2010 Yamamoto ..... G09G 3/3233 345/213
2011/0134100 A1* 6/2011 Chung ..... G09G 3/325 345/212
2011/0157135 A1* 6/2011 Lee ..... G09G 3/3291 345/211
2011/0164071 A1* 7/2011 Chung ..... G09G 3/3233 345/690
2013/0335391 A1* 12/2013 Kim ..... G09G 3/3291 345/211
2014/0084805 A1* 3/2014 Kim ..... G09G 3/2048 315/228
2014/0347338 A1* 11/2014 Yamashita ..... G09G 5/10 345/211
2015/0070408 A1* 3/2015 Lim ..... G09G 3/3233 345/690
2015/0123557 A1* 5/2015 Lee ..... G09G 3/3233 315/228
2016/0005384 A1* 1/2016 Yoon ..... G09G 3/3233 345/213
2016/0055792 A1* 2/2016 Lee ..... G09G 3/3233 315/173
2016/0240142 A1* 8/2016 Jeong ..... G09G 3/3258
2016/0322450 A1* 11/2016 Lee ..... H01L 27/3265
2016/0351119 A1* 12/2016 Ono ..... H01L 51/56
2017/0040408 A1* 2/2017 Choi ..... H01L 27/1225
2020/0066207 A1* 2/2020 Gu ..... G09G 3/3275
2020/0202785 A1* 6/2020 Yang ..... G06F 3/0445

* cited by examiner

DISPLAY APPARATUS

CROSS-REFERENCE TO RELATED APPLICATIONS

This application claims the priority benefit of the Korean Patent Application No. 10-2018-0174088 filed in the Republic of Korea on Dec. 31, 2018, which is hereby incorporated by reference as if fully set forth herein.

BACKGROUND

Field of the Invention

The present disclosure relates to a display apparatus.

Discussion of the Related Art

A display apparatus is widely used as a display screen of a notebook computer, a tablet computer, a smartphone, a portable display device, and a portable information device, and the like, in addition to a display apparatus of a television or a monitor.

Specific examples of such a display apparatus include a liquid crystal display (LCD) apparatus, an organic light emitting display (OLED) apparatus, a quantum dot display apparatus, and the like.

An organic light emitting display apparatus, which displays an image using a self-luminous device, has a high response speed, low power consumption, and no problem with a viewing angle, and as such, the organic light emitting display apparatus has come to prominence as the next-generation display apparatus.

A current flowing in a light emitting device of each pixel of the organic light emitting display apparatus can be changed due to variations in the threshold voltage or the like of driving transistors due to process variations and the like. In a general organic light emitting display apparatus, luminance non-uniformity can occur due to luminance variations between pixels due to the variations of electrical characteristics of the driving transistors and degradation variations of the light emitting devices that occur between the pixels. In particular, the degradation deviations of the light emitting devices that occur between the pixels can be caused by different degradation speeds of each pixel according to a driving time of the organic light emitting display apparatus, and can cause a luminance non-uniformity phenomenon, a luminance degradation phenomenon, and a residual image phenomenon.

The light emitting device of the organic light emitting display can emit light from a moment when a voltage of an anode electrode of the light emitting device is larger than a threshold voltage of the light emitting device. Also, in the organic light emitting display apparatus of the related art, even when a data voltage has a minimum value that can be implemented in a driving circuit system, the voltage of the anode electrode of the light emitting device can be larger than the threshold voltage of the light emitting device, causing problems that the light emitting device can slightly emit light and deep black cannot be realized. Further, when a gate-source voltage of the driving transistor is reduced to realize deep black of the display apparatus, a data voltage margin is reduced.

SUMMARY

Accordingly, the present disclosure is directed to providing a display apparatus that substantially obviates one or more problems due to limitations and disadvantages of the related art.

An aspect of the present disclosure is directed to providing a display apparatus which realizes deep black, while securing a data voltage margin, by dropping a voltage of an anode electrode of a light emitting device to a threshold voltage (or lower) of the light emitting device when a data voltage has a predetermined minimum value.

Another aspect of the present disclosure is directed to providing a display apparatus capable of preventing light emission of a light emitting device when a data voltage has a predetermined minimum value by dropping a voltage of an anode electrode of the light emitting device in synchronization with a falling time of a scan signal.

Additional advantages and features of the disclosure will be set forth in part in the description which follows and in part will become apparent to those having ordinary skill in the art upon examination of the following or may be learned from practice of the disclosure. The objectives and other advantages of the disclosure may be realized and attained by the structure particularly pointed out in the written description and claims hereof as well as the appended drawings.

To achieve these and other advantages and in accordance with the purpose of the disclosure, as embodied and broadly described herein, there is provided a display apparatus including a pixel including a pixel circuit having a driving transistor and a light emitting device connected to the pixel circuit, wherein the pixel circuit includes: a driving transistor controlling a driving current flowing at the light emitting device; a data supply transistor selectively providing a data voltage to a first node which is a source electrode of the driving transistor; a first light emitting control transistor selectively connecting the first node to a second node which is an anode electrode of the light emitting device; a first light emitting control transistor selectively connecting the first node and the second node which is an anode electrode of the light emitting device; a first initialization transistor selectively providing an initialization voltage to the second node; a second light emitting control transistor selectively providing a driving voltage to a third node which is a drain electrode of the driving transistor; a second light emitting control transistor selectively providing a driving voltage to a third node which is a drain electrode of the driving transistor, a second initialization transistor selectively connecting the third node to a fourth node which is a gate electrode of the driving transistor; a first capacitor connected between the second node and the fourth node; and a second capacitor connected between the second node and a gate electrode of the data supply transistor.

It is to be understood that both the foregoing general description and the following detailed description of the present disclosure are exemplary and explanatory and are intended to provide further explanation of the disclosure as claimed.

BRIEF DESCRIPTION OF THE DRAWINGS

The accompanying drawings, which are included to provide a further understanding of the disclosure and are incorporated in and configure a part of this application, illustrate embodiments of the disclosure and together with the description serve to explain the principle of the disclosure. In the drawings.

DETAILED DESCRIPTION OF THE DISCLOSURE

Figure 1:
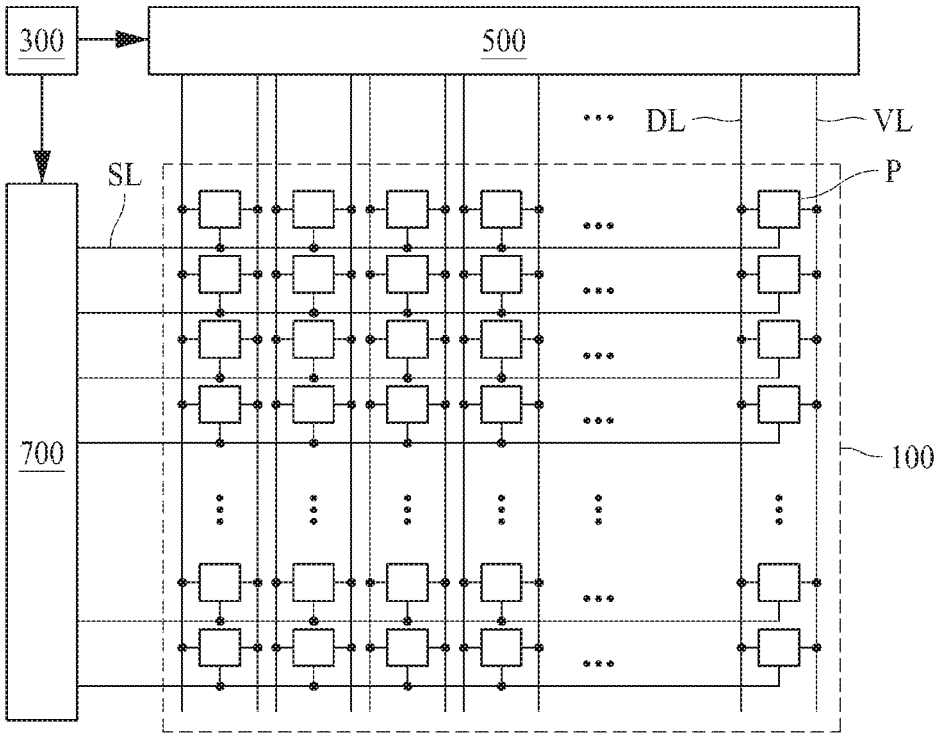
FIG. 1 is a view showing a display apparatus according to an example of the present disclosure.

Reference will now be made in detail to the exemplary embodiments of the present disclosure, examples of which are illustrated in the accompanying drawings. Wherever possible, the same reference numbers will be used throughout the drawings to refer to the same or like parts.

Advantages and features of the present disclosure, and implementation methods thereof will be clarified through following embodiments described with reference to the accompanying drawings. The present disclosure may, however, be embodied in different forms and should not be construed as limited to the embodiments set forth herein. Rather, these embodiments are provided so that this disclosure will be thorough and complete, and will fully convey the scope of the present disclosure to those skilled in the art. Furthermore, the present disclosure is only defined by scopes of claims.

A shape, a size, a ratio, an angle, and a number disclosed in the drawings for describing embodiments of the present disclosure are merely an example, and thus, the present disclosure is not limited to the illustrated details. Like reference numerals refer to like elements throughout. In the following description, when the detailed description of the relevant known technology is determined to unnecessarily obscure the relevant point(s) of the present disclosure, the detailed description will be omitted or may be brief. In a case where 'comprise', 'have', and 'include' described in the present specification are used, another part can be added unless 'only-' is used. The terms of a singular form can include plural forms unless referred to the contrary.

In construing an element, the element is construed as including an error range although there is no explicit description.

In describing a position relationship, for example, when a position relation between two parts is described as 'on-', 'over-', 'under-', and 'next-', one or more other parts can be disposed between the two parts unless 'just' or 'direct' is used.

In describing a time relationship, for example, when the temporal order is described as 'after-', 'subsequent-', 'next-', and 'before-', a case which is not continuous can be included unless 'just' or 'direct' is used.

It will be understood that, although the terms "first", "second", etc. can be used herein to describe various elements, these elements should not be limited by these terms. These terms are only used to distinguish one element from another. For example, a first element could be termed a second element, and, similarly, a second element could be termed a first element, without departing from the scope of the present disclosure.

In describing elements of the present disclosure, the terms "first", "second", etc. can be used. The terms are merely for differentiating one element from another element, and the essence, sequence, order, or number of a corresponding element should not be limited by the terms. It will be understood that when an element or layer is described as being "connected", "coupled", or "adhered" to another element or layer, the element or layer can be directly connected or adhered to the other element or layer, but the other element or layer can be "disposed" between elements or layers, or elements or layers can be "connected", "coupled", or "adhered" to each other through the other element or layer.

Features of various embodiments of the present disclosure can be partially or overall coupled to or combined with each other, and can be variously inter-operated with each other and driven technically as those skilled in the art can sufficiently understand. The embodiments of the present disclosure can be carried out independently from each other, or can be carried out together in co-dependent relationship.

Hereinafter, embodiments of a light emitting display apparatus according to the present disclosure will be described in detail with reference to the accompanying drawings. In adding reference numerals to elements of each of the drawings, although the same elements are illustrated in other drawings, like reference numerals can refer to like elements.

FIG. 1 is a plan view showing a display apparatus according to an example of the present disclosure. All the components of the display apparatus according to all embodiments of the present disclosure are operatively coupled and configured.

Referring to FIG. 1, the display apparatus includes a display panel 100, a timing controller 300, a data driving circuit 500, and a scan driving circuit 700.

The display panel 100 can include a plurality of data lines DL, a plurality of scan lines SL, a plurality of voltage supply lines VL, and a plurality of pixels P.

Each of the plurality of data lines DL can extend in a first direction and can be spaced apart from each other in a second direction intersecting the first direction. Each of the plurality of scan lines SL can extend along the second direction and can be spaced from each other along the first direction. Each of the plurality of voltage supply lines VL can extend along the first direction and can be spaced apart from each other along the second direction. The directions of the plurality of data lines DL, the plurality of scan lines SL, and the plurality of voltage supply lines VL are not limited thereto, and the first direction and the second direction in which the respective lines are arranged can be replaced with each other or can be varied.

Each of the plurality of pixels P can be disposed at each pixel region defined by the corresponding scan line SL, the corresponding data line DL, and the corresponding voltage supply line VL disposed in the display region of the display panel 100.

According to an example, the plurality of pixels P can include a red subpixel, a green subpixel, and a blue subpixel. For example, red, green, and blue subpixels arranged along a lengthwise direction of the scan line SL (or data line DL) can configure a unit pixel that displays an image. Additionally, the unit pixel can further include a white pixel or can include other variations.

According to an example, each of the plurality of pixels P can include a pixel circuit having a driving transistor and a light emitting device connected to the pixel circuit.

The light emitting device of each pixel P can be interposed between a first electrode (e.g., anode electrode) connected to the pixel circuit and a second electrode (e.g., cathode electrode) connected to a common power source.

According to an example, the light emitting device can include an organic light emitting device, a quantum dot light emitting device, an inorganic light emitting device, or a micro-light emitting diode device. Such a light emitting device can emit light in proportion to the amount of a data current supplied from the pixel circuit, thereby emitting color light having a predetermined luminance.

The pixel circuit of each pixel P can drive the light emitting device by controlling a driving current flowing in the light emitting device on the basis of a scan signal and a control signal. An example of one configuration of the pixel circuit for each pixel P will be described later in detail with reference to FIGS. 2 to 4D below.

The timing controller 300 can generate pixel data corresponding to each of the plurality of pixels P on the basis of an image signal. The timing controller 300 can generate a data control signal on the basis of a timing synchronization signal and provide the data control signal to the data driving circuit 500. According to an example, the timing controller 300 can generate a scan control signal including a start signal and a plurality of scan clock signals on the basis of the timing synchronization signal, and provide the scan control signal to the scan driving circuit 700. The timing controller 300 can further generate a plurality of carry clock signals according to a driving method of the scan driving circuit 700 and provide the generated signals to the scan driving circuit 700.

The data driving circuit 500 can be connected to the plurality of data lines DL provided in the display panel 100. The data driving circuit 500 can receive the pixel data and the data control signal provided from the timing controller 300, and receive a plurality of reference gamma voltages provided from a power supply circuit. The data driving circuit 500 can convert pixel data into an analog data signal for each pixel using the data control signal and the plurality of reference gamma voltages, and supply the converted data signal for each pixel to the corresponding data lines DL.

The scan driving circuit 700 can be connected to the plurality of scan lines SL provided in the display panel 100. For example, the scan driving circuit 700 can generate scan signals according to a predetermined order on the basis of the scan control signal supplied from the timing controller 300, and supply the generated scan signal to the corresponding scan line SL.

According to an example, the scan driving circuit 700 can be integrated on one edge or both edges of a substrate according to a manufacturing process of a thin film transistor (TFT) and connected to the plurality of scan lines SL in a one-to-one manner. For example, the scan driving circuit 700 can be formed in an integrated circuit and mounted on a substrate or mounted on a flexible circuit film and connected to each of the plurality of scan lines SL.

Figure 2:
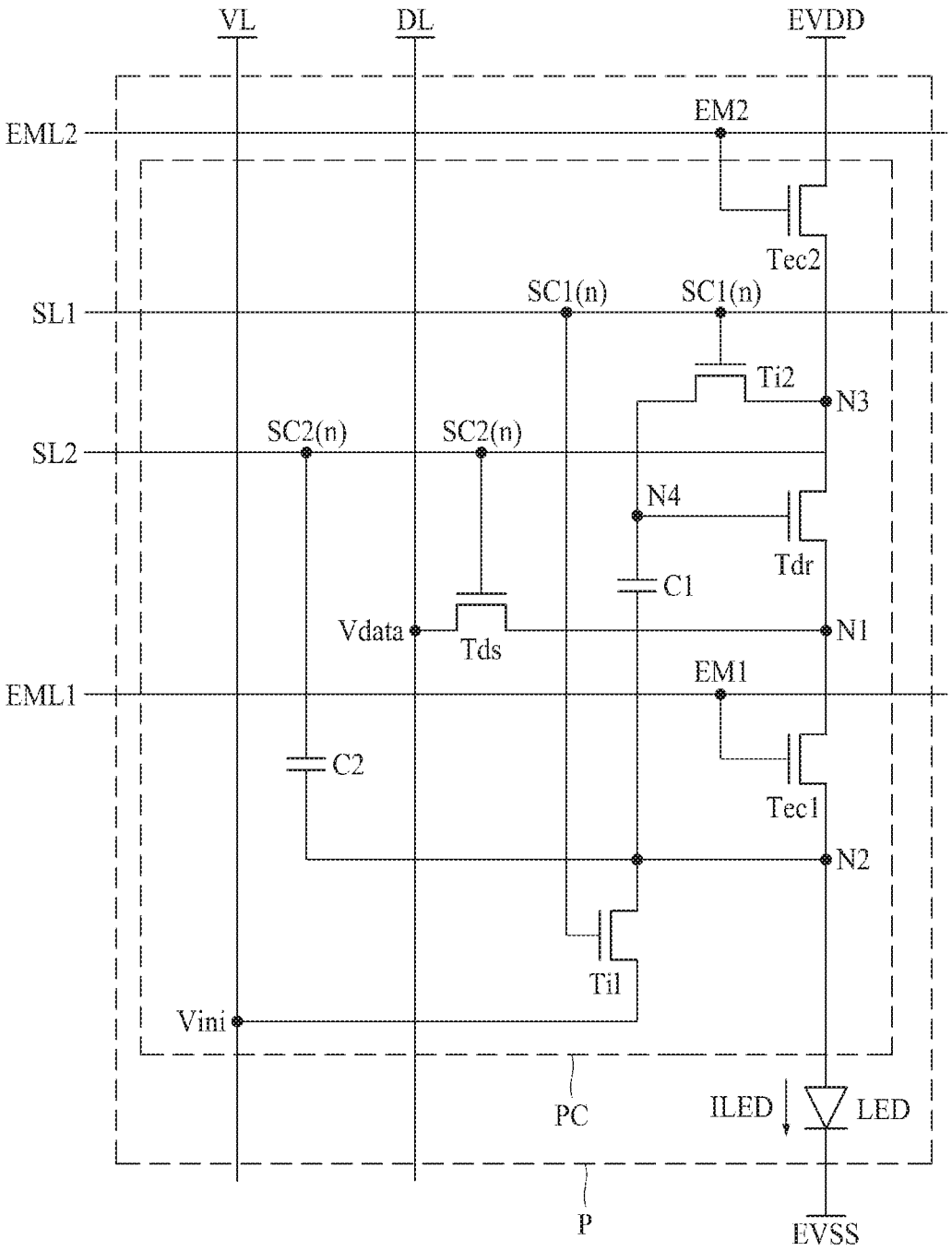
FIG. 2 is a circuit diagram showing a pixel in the display apparatus shown in FIG. 1.

FIG. 2 is a circuit diagram showing an example of each of the pixels P in the display apparatus shown in FIG. 1.

Referring to FIG. 2 and as mentioned above, each of the plurality of pixels P can include a pixel circuit PC having a driving transistor Tdr (e.g., driving TFT) and a light emitting device LED (e.g., organic light emitting diode) connected to the pixel circuit PC.

The pixel circuit PC can drive the light emitting device LED by controlling a driving current ILED flowing in the light emitting device LED. According to an example, the pixel circuit PC can include the driving transistor Tdr, first and second initialization transistors Ti1 and Ti2, a data supply transistor Tds, first and second light emitting control transistors Tec1 and Tec2, and first and second capacitors C1 and C2.

The driving transistor Tdr can control the driving current ILED flowing in the light emitting device LED. The driving transistor Tdr can selectively connect a third node N3 and a first node N1. For example, the driving transistor Tdr can be disposed between the third node N3 and the first node N1 to selectively provide the driving current ILED to the light emitting device LED. For example, a drain electrode of the driving transistor Tdr can be connected to the third node N3, a source electrode of the driving transistor Tdr can be connected to the first node N1, and a gate electrode of the driving transistor Tdr can be connected to a fourth node N4.

The drain electrode of the driving transistor Tdr can be connected to a source electrode of the second light emitting control transistor Tec2 and a drain electrode of the second initialization transistor Ti2 through the third node N3. The source electrode of the driving transistor Tdr can be connected to a drain electrode of the first light emitting control transistor Tec1 and a source electrode of the data supply transistor Tds through the first node N1. The gate electrode of the driving transistor Tdr can be connected to a source electrode of the second initialization transistor Ti2 and one end of the first capacitor C1 through the fourth node N4. Therefore, the driving transistor Tdr can be turned on based on a voltage of the fourth node N4 and provide the driving current ILED supplied from the third node N3 to the first node N1.

The first initialization transistor Ti1 can be turned on based on a first scan signal SC1(*n*) to electrically connect the voltage supply line VL and the second node N2 where n can be a natural number such as a positive integer. Here, the voltage supply line VL can correspond to or can be an initialization line that provides the initialization voltage Vini to the second node N2. For example, a drain electrode of the first initialization transistor Ti1 can be connected to the voltage supply line VL for receiving the initialization voltage Vini, a source electrode of the first initialization transistor Ti1 can be connected to the second node N2, and a gate electrode of the first initialization transistor Ti1 can be connected to the first scan line SL1 for receiving the first scan signal SC1(*n*).

The drain electrode of the first initialization transistor Ti1 can receive the initialization voltage Vini from the voltage supply line VL. The source electrode of the first initialization transistor Ti1 can be connected to the source electrode of the first light emitting control transistor Tec1, the other end of the first capacitor C1, the other end of the second capacitor C2, and the anode electrode of the light emitting device LED through the second node N2. The gate electrode of the first initialization transistor Ti1 can receive the first scan signal SC1(*n*) from the first scan line SL1. Thus, the first initialization transistor Ti1 can be turned on based on the first scan signal SC1(*n*) and selectively provide the initialization voltage Vini to the second node N2.

The second initialization transistor Ti2 can be turned on based on the first scan signal SC1(*n*) to electrically connect the third node N3 and the fourth node N4. For example, the drain electrode of the second initialization transistor Ti2 can be connected to the third node N3, the source electrode of the second initialization transistor Ti2 can be connected to the fourth node N4, and the gate electrode of the first scan line Ti2 can be connected to the first scan line SL1.

The drain electrode of the second initialization transistor Ti2 can be connected to the source electrode of the second light emitting control transistor Tec2 and the drain electrode of the driving transistor Tdr through the third node N3. The source electrode of the second initialization transistor Ti2 can be connected to the gate electrode of the driving transistor Tdr and one end of the first capacitor C1 through the fourth node N4. The gate electrode of the second initialization transistor Ti2 can receive the first scan signal SC1(*n*) from the first scan line SL1. Thus, the second initialization transistor Ti2 can be turned on based on the first scan signal SC1(*n*) and selectively provide a voltage at the third node N3 to the fourth node N4.

The data supply transistor Tds can be turned on based on a second scan signal SC2(*n*) to electrically connect the data line DL and the first node N1. For example, the drain electrode of the data supply transistor Tds can be connected to the data line DL for receiving a data voltage Vdata, the source electrode of the data supply transistor Tds can be connected to the first node N1, and the gate electrode of the data supply transistor Tds can be connected to the second scan line SL2 for receiving the second scan signal SC2(*n*).

The drain electrode of the data supply transistor Tds can receive the data voltage Vdata from the data line DL. The source electrode of the data supply transistor Tds can be connected to the source electrode of the driving transistor Tdr and the drain electrode of the first light emitting control transistor Tec1 through the first node N1. The gate electrode of the data supply transistor Tds can receive the second scan signal SC2(*n*) from the second scan line SL2. Thus, the data supply transistor Tds can be turned on based on the second scan signal SC2(*n*) and selectively provide the data voltage Vdata to the first node N1.

The first light emitting control transistor Tec1 can be turned on based on a first emission signal EM1 to electrically connect the first node N1 and the second node N2. For example, the drain electrode of the first light emitting control transistor Tec1 can be connected to the first node N1, the source electrode of the first light emitting control transistor Tec1 can be connected to the second node N2, and the gate electrode of the light emitting control transistor Tec1 can be connected to a first emission control line EML1 for receiving the first emission signal EM1.

The drain electrode of the first light emitting control transistor Tec1 can be connected to the source electrode of the driving transistor Tdr and the source electrode of the data supply transistor Tds through the first node N1. The source electrode of the light emitting control transistor Tec1 can be connected to the other end of the first capacitor C1, the other end of the second capacitor C2, the source electrode of the first initialization transistor Ti1, and the anode electrode of the light emitting device LED through the second node N2. The gate electrode of the first light emitting control transistor Tec1 can receive the first emission signal EM1 from the first emission control line EML1. Therefore, the first light emitting control transistor Tec1 can be turned on based on the first emission signal EM1 and selectively provide a voltage at the first node N1 to the second node N2.

The second light emitting control transistor Tec2 can be turned on based on a second emission signal EM2 to electrically connect a driving power source EVDD to the third node N3. For example, the drain electrode of the second light emitting control transistor Tec2 can be connected to the driving power source EVDD, the source electrode of the second light emitting control transistor Tec2 can be connected to the third node N3, and the gate electrode of the light emitting control transistor Tec2 can be connected to a second emission control line EML2 for receiving the second emission signal EM2.

The drain electrode of the second light emitting control transistor Tec2 can receive a driving voltage VDD from the driving power source EVDD. The source electrode of the second light emitting control transistor Tec2 can be connected to the drain electrode of the driving transistor Tdr and the drain electrode of the second initialization transistor Ti2 through the third node N3. The gate electrode of the second light emitting control transistor Tec2 can receive the second emission signal EM2 from the second emission control line EML2. Therefore, the second light emitting control transistor Tec2 can be turned on based on the second emission signal EM2 and selectively provide the driving voltage VDD to the third node N3.

The first capacitor C1 can be connected between the fourth node N4 and the second node N2. For example, the first capacitor C1 can control a voltage of the fourth node N4 by storing a difference voltage between the fourth node N4 and the second node N2. For example, even if the second initialization transistor Ti2 is turned off, the voltage of the fourth node N4 can be kept constant by a potential difference between one end and the other end of the first capacitor C1. As a result, even if the second initialization transistor Ti2 is turned off, the first capacitor C1 can keep the voltage of the fourth node N4 constant, thereby controlling the operation of the driving transistor Tdr.

The second capacitor C2 can be connected between the second scan line SL2 and the second node N2. For example, the second capacitor C2 can control the voltage of the second node N2 by storing a difference voltage between the second scan line SL2 and the second node N2. For example, the second capacitor C2 can raise the voltage of the second node N2 when the second scan signal SC2(*n*) provided from the second scan line SL2 rises, and can lower the voltage of the second node N2 when the second scan signal SC2(*n*) falls. As a result, the voltage of the second node N2 can be controlled in synchronization with (e.g., in the same manner as) a rising time or a falling time of the second scan signal SC2(*n*).

Figure 3:
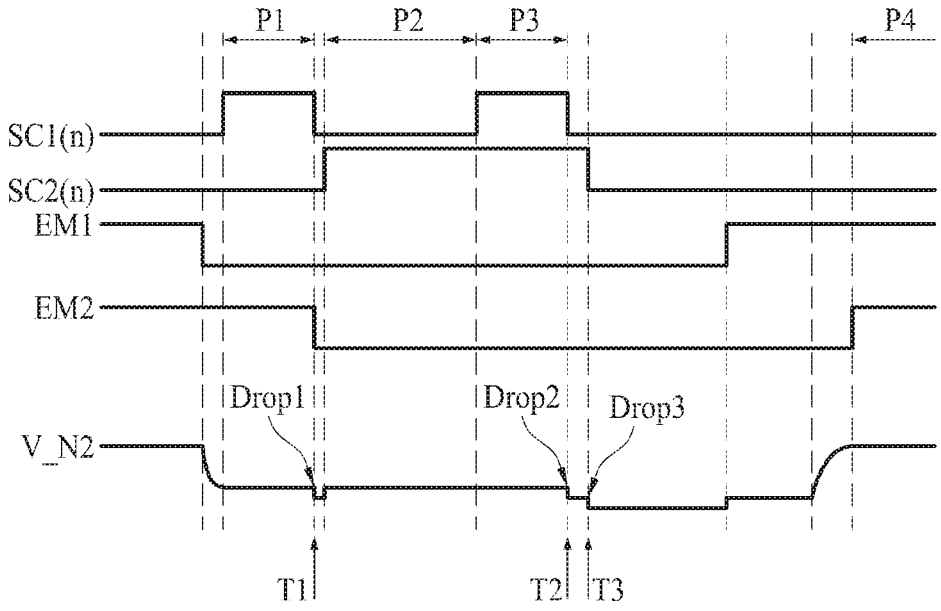
FIG. 3 is a waveform view illustrating driving of a pixel circuit and a light emitting device in the pixel of the display apparatus shown in FIG. 2.

FIG. 3 is a waveform view illustrating driving of the pixel circuit and the light emitting device in the pixel of the display apparatus shown in FIG. 2, and FIGS. 4A to 4D are views illustrating driving of the pixel circuit and the light emitting device according to an initialization period, a programming period, a sampling period, and an emission period in the pixel of the display apparatus shown in FIG. 2.

Referring to FIGS. 3 and 4A to 4D, each of the plurality of pixels P can be driven through an initialization period P1, a programming period P2, a sampling period P3, and an emission period P4.

The first scan line SL1 can be connected to the gate electrode of the first initialization transistor Ti1 and the gate electrode of the second initialization transistor Ti2. For example, the first scan line SL1 can supply the first scan signal SC1(*n*) to the gate electrodes of the first and second initialization transistors Ti1 and Ti2 to turn on or turn off the first and second initialization transistors Ti1 and Ti2, respectively. Here, the first scan signal SC1(*n*) can have a high level in the initialization period P1 and the sampling period P3 and have a low level in the programming period P2 and the emission period P4. Therefore, the first initialization transistor Ti1 can be turned on upon receiving the first scan signal SC1(*n*) having the high level in the initialization period P1 and the sampling period P3, and provide the initialization voltage Vini to the second node N2. The second initialization transistor Ti2 can be turned on upon receiving the first scan signal SC1(*n*) having the high level in the initialization period P1 and the sampling period P3, and provide a voltage of the node N3 to the fourth node N4.

The second scan line SL2 can be connected to the gate electrode of the data supply transistor Tds. For example, the second scan line SL2 can supply the second scan signal SC2(*n*) to the gate electrode of the data supply transistor Tds to turn on or off the data supply transistor Tds. Here, the second scan signal SC2(*n*) can have a high level in the programming period P2 and the sampling period P3 and have a low level in the initialization period P1 and the emission period P4. Therefore, the data supply transistor Tds can be turned on upon receiving the second scan signal SC2(*n*) having the high level during the programming period P2 and the sampling period P3, and provide the data voltage Vdata to the first node N1.

The first emission control line EML1 can be connected to the gate electrode of the first light emitting control transistor Tec1. For example, the first emission control line EML1 can supply the first emission signal EM1 to the gate electrode of the first light emitting control transistor Tec1 to turn on or turn off the first light emitting control transistor Tec1. Here, the first emission signal EM1 can have a high level in the emission period P4 and have a low level in the initialization period P1, the programming period P2, and the sampling period P3. Therefore, the first light emitting control transistor Tec1 can be turned on upon receiving the first emission signal EM1 having a high level during the emission period P4, and provide a voltage of the first node N1 to the second node N2.

The second emission control line EML2 can be connected to the gate electrode of the second light emitting control transistor Tec2. For example, the second emission control line EML2 can supply the second emission signal EM2 to the gate electrode of the second light emitting control transistor Tec2 to turn on or turn off the second light emitting control transistor Tec2. Here, the second emission signal EM2 can have a high level during the initialization period P1 and the emission period P4 and have a low level during the programming period P2 and the sampling period P3. Therefore, the second light emitting control transistor Tec2 can be turned on upon receiving the second emission signal EM2 having a high level during the initialization period P1 and the emission period P4, and provide the driving voltage VDD to the third node N3.

Figure 4A:
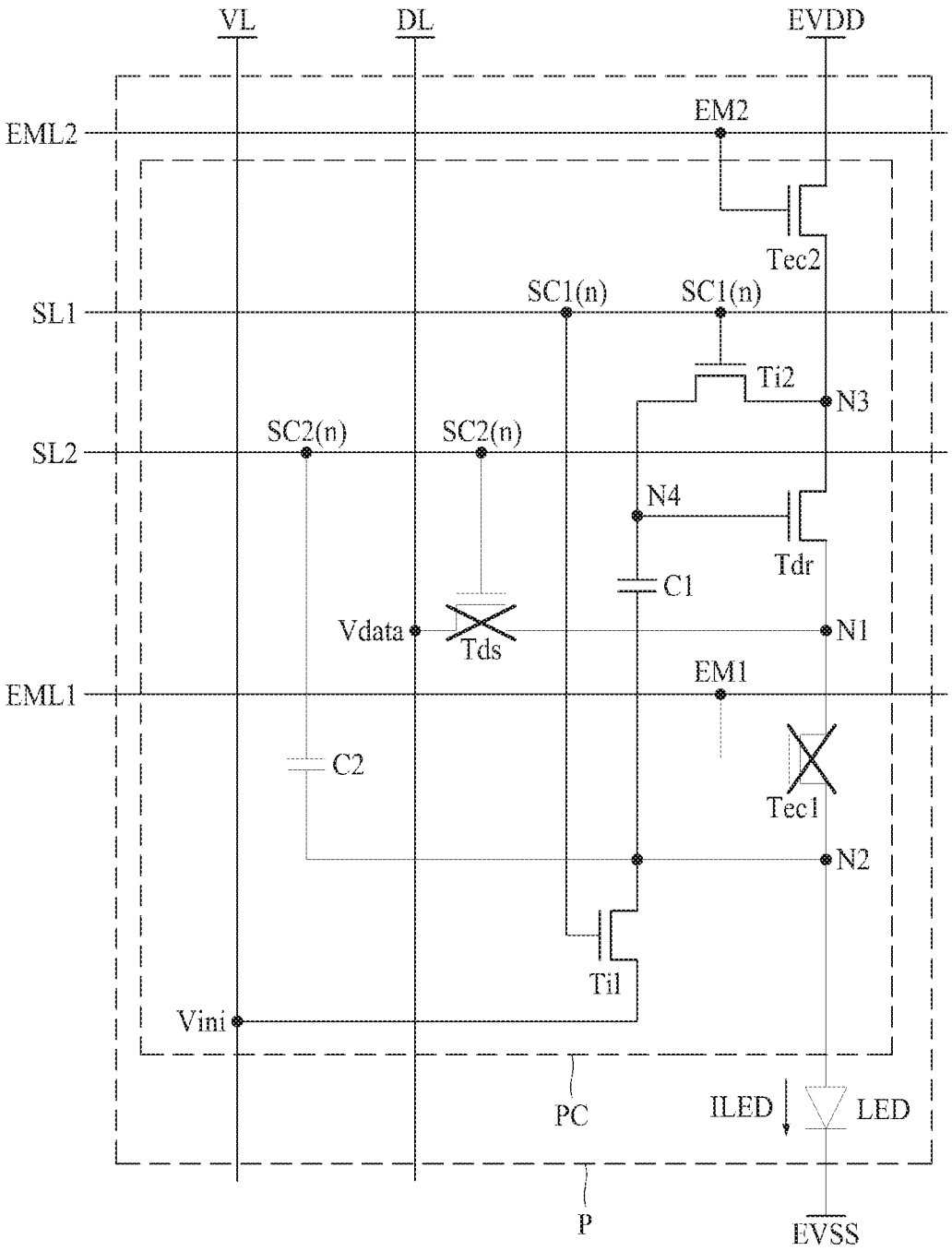
FIGS. 4A to 4D are views illustrating driving of the pixel circuit and the light emitting device according to an initialization period, a programming period, a sampling period, and an emission period in the pixel of the display apparatus shown in FIG. 2.

In FIG. 4A, the first initialization transistor Ti1 can be turned on during the initializing period P1 on the basis of the first scan signal SC1(*n*) to provide the initialization voltage Vini to the second node N2. For example, the second node N2, which is the anode electrode of the light emitting device LED, can be initialized upon receiving the initialization voltage Vini during the initialization period P1.

The second light emitting control transistor Tec2 can be turned on during the initialization period P1 on the basis of the second emission signal EM2 and provide the driving voltage VDD to the third node N3, and the second initialization transistor Ti2 can be turned on during the initializing period P1 on the basis of the first scan signal SC1(*n*) and provide the voltage of the third node N3 to the fourth node N4. For example, the second light emitting control transistor Tec2 and the second initialization transistor Ti2 can be turned on simultaneously during the initialization period P1 and provide the driving voltage VDD to the fourth node N4 which is one end of the first capacitor C1.

As described above, during the initializing period P1, the driving voltage VDD can be supplied to the fourth node N4, which is one end of the first capacitor C1, and the initialization voltage Vini can be supplied to the second node N2, which is the other end of the first capacitor C1. For example, the first capacitor C1 can store a difference voltage (VDD−Vini) between the driving voltage VDD and the initialization voltage Vini during the initialization period P1.

According to an example, an initialized voltage V_N2 of the second node N2 can be dropped (Drop1) in synchronization with a falling time T of the first scan signal SC1(*n*). For example, the pixel circuit PC can further include an internal capacitor connected between the gate electrode of the first initialization transistor Ti1 and the second node N2. For example, one end of the internal capacitor can be connected to the gate electrode of the first initialization transistor Ti1, and the other end of the internal capacitor can be connected to the second node N2. Here, the first scan signal SC1(*n*) can rise at a start time of the initialization period P1 to have a high level and the internal capacitor can store a difference voltage between both ends of the internal capacitor. The first scan signal SC1(*n*) can fall at an end time of the initialization period P1 to have a low level and the internal capacitor can drop a voltage V_N2 of the second node N2 on the basis of the stored potential difference. Therefore, the voltage V_N2 of the second node N2 can have a voltage lower than the initialization voltage Vini in synchronization with the falling time T1 of the first scan signal SC1(*n*).

Figure 4B:
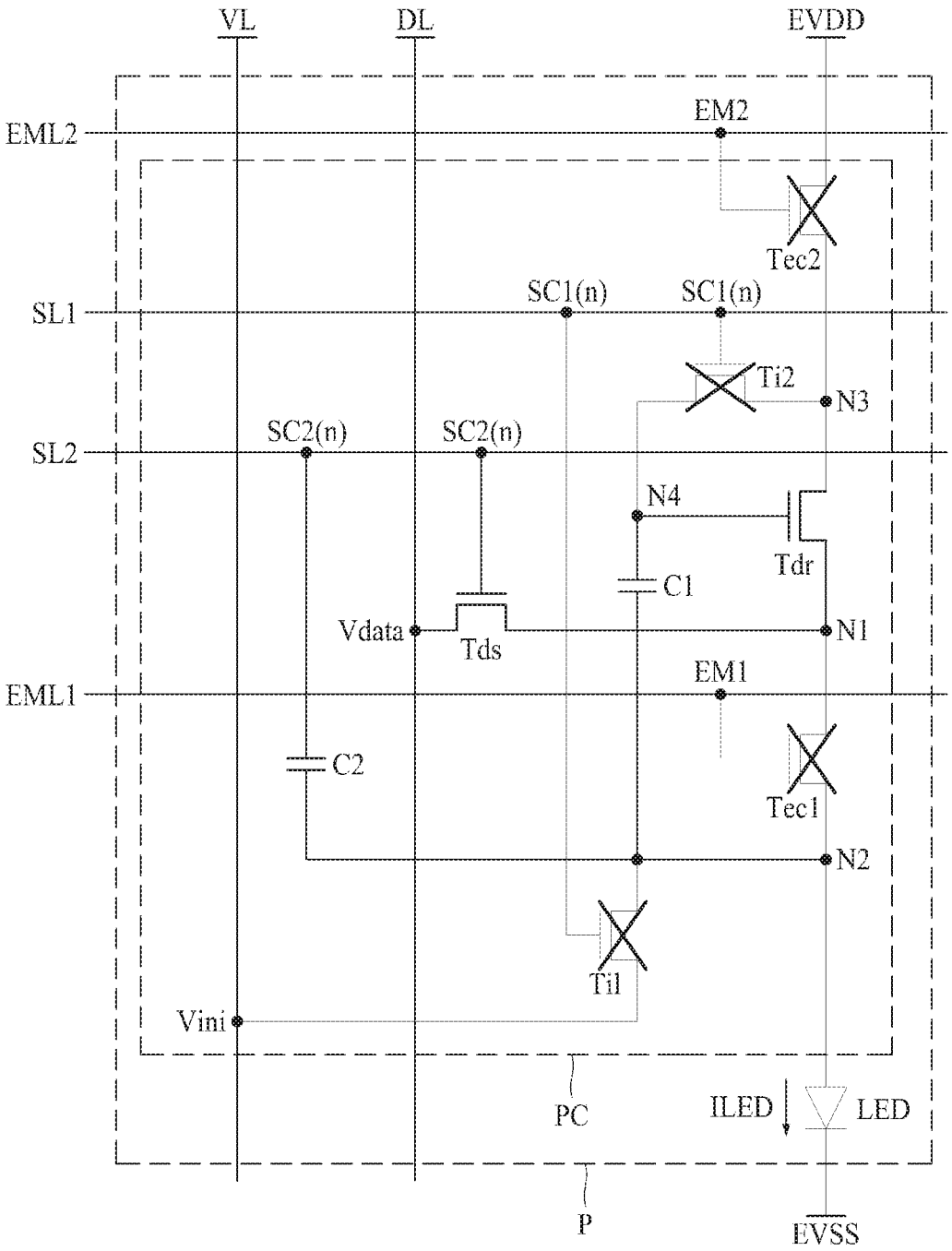

In FIG. 4B, the first and second initialization transistors Ti1 and Ti2 and the second light emitting control transistor Tec2 can be turned off. The data supply transistor Tds can be turned on during the programming period P2 on the basis of the second scan signal SC2(*n*) and provide the data voltage Vdata to the first node N1. Accordingly, the first node N1, which is the source electrode of the driving transistor Tdr, can be continuously supplied with the data voltage Vdata.

Figure 4C:
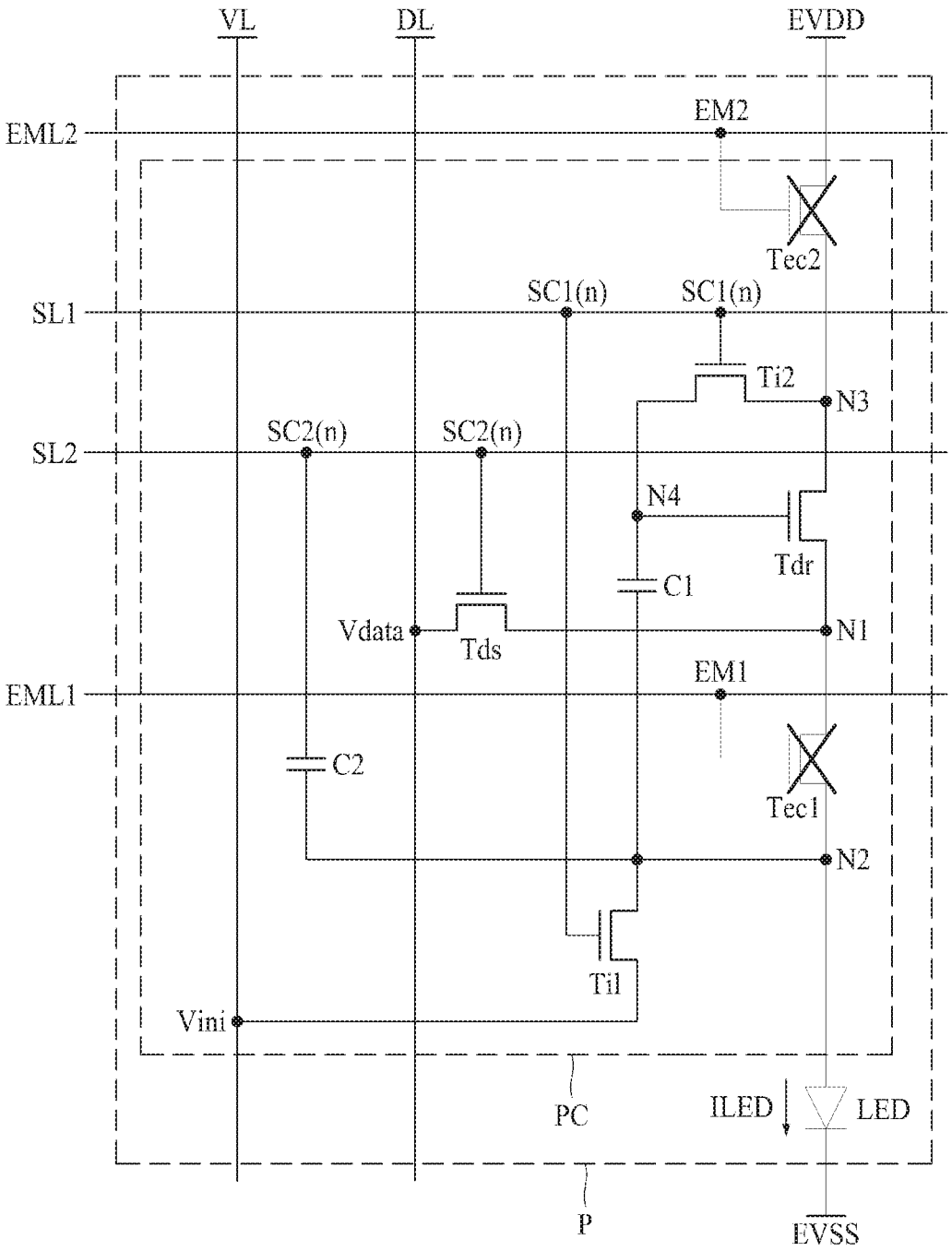

In FIG. 4C, the data supply transistor Tds can be turned on even during the sampling period P3 on the basis of the second scan signal SC2(*n*), and the first and second initialization transistors Ti1 and Ti2 can be turned on during the sampling period P3 on the basis of the first scan signal SC1(*n*). Here, the fourth node N4, which is the gate electrode of the driving transistor Tdr, can have the driving voltage VDD stored by the first capacitor C1 before the sampling period P3, and the first node N1, which is the source electrode of the driving transistor Tdr, can have the data voltage Vdata provided during the immediately preceding programming period P2. For example, a gate-source voltage Vgs of the driving transistor Tdr can correspond to a difference voltage (VDD-Vdata) between the driving voltage VDD and the data voltage Vdata, and the gate-source voltage Vgs of the driving transistor Tdr can be higher than a threshold voltage Vth so as to be turned on. Therefore, the moment the driving transistor Tdr is first turned on during the sampling period P3, a drain-source current Ids of the driving transistor Tdr can be determined according to the driving voltage VDD, the data voltage Vdata, and threshold voltage Vth of the driving transistor Tdr (Ids=k*(VDD−Vdata−Vth)^2). The driving transistor Tdr can provide the drain-source current Ids to the first node N1 until the gate-source voltage Vgs reaches the threshold voltage Vth of the driving transistor Tdr. In this manner, the voltage of the fourth node N4 and the drain-source current Ids of the driving transistor Tdr can be changed from the moment when the driving transistor Tdr is first turned on during the sampling period P3, and the voltage of the fourth node N4 can be converged to a sum voltage (Vdata+Vth) of the data voltage Vdata and the threshold voltage Vth of the driving transistor Tdr.

According to an example, the voltage V_N2 of the second node N2 can be dropped (Drop2) in synchronization with a falling time T2 of the first scan signal SC1(*n*) of the sampling period P3. For example, the pixel circuit PC can further include an internal capacitor connected between the gate electrode of the first initialization transistor Ti1 and the second node N2. For example, one end of the internal capacitor can be connected to the gate electrode of the first initialization transistor Ti1, and the other end of the internal capacitor can be connected to the second node N2. Here, the internal capacitor can maintain a potential difference stored in the initialization period P1, and the first scan signal SC1(*n*) can be lowered at an end time of the sampling period P3 to have a low level. Therefore, the internal capacitor can drop the voltage V_N2 of the second node N2 on the basis of the stored potential difference. Therefore, the voltage V_N2 of the second node N2 can have a voltage lower than the initialization voltage Vini in synchronization with the falling time T2 of the first scan signal SC1(*n*).

According to an example, the second capacitor C2 can drop (Drop3) the voltage V_N2 of the second node N2 in synchronization with a falling time T3 of the second scan signal SC2(*n*). For example, the voltage V_N2 of the second node N2 can be dropped (Drop2) in synchronization with the falling time T2 of the first scan signal SC1(*n*) of the sampling period P3 and subsequently can be further dropped (Drop3) in synchronization with the falling time T3 of the second scan signal SC2(*n*) after the sampling period P3. For example, one end of the second capacitor C2 can be connected to the second scan line SL2, and the other end of the second capacitor C2 can be connected to the second node N2. Here, the second scan signal SC2(*n*) can rise at a start time of the programming period P2 to have a high level, and the second capacitor C2 can store a difference voltage between both ends of the second capacitor C2. The second scan signal SC2(*n*) can be lowered to have a low level after the sampling period P3, and the voltage at one end of the second capacitor C2 can be lowered. Therefore, the second capacitor C2 can drop the voltage V_N2 of the second node N2, which is the other end of the second capacitor C2, on the basis of the stored potential difference.

According to an example, when the data voltage Vdata has a predetermined minimum value, the second capacitor C2 can drop the voltage V_N2 of the second node N2 to the threshold voltage Vth or lower of the light emitting device LED during the emission period P4. For example, when the voltage V_N2 charged in the second node N2 is high until immediately before the emission period P4, the voltage of the second node N2 in the emission period P4 can be increased to be higher than the threshold voltage Vth of the light emitting device LED, and thus, the light emitting device LED can emit light. In a light emitting display apparatus of the related art, even when the data voltage has a minimum value that can be implemented in the driving circuit system, the voltage of the anode electrode of the light emitting device is increased to be higher than the threshold voltage of the light emitting device, and thus, the light emitting device can slightly emit light, resulting in a problem of deep black not being realized.

In order to address this limitation associated with the related art, the display apparatus according to the present disclosure includes the second capacitor C2 connected between the second scan line SL2 and the second node N2, which is the anode electrode of the light emitting device LED, thereby reducing the voltage V_N2 charged to the second node N2 immediately before the emission period P4. For example, the voltage V_N2 of the second node N2 can be dropped (Drop2) in synchronization with the falling time T2 of the first scan signal SC1(*n*) of the sampling period P3, and the second capacitor C2 can drop (Drop3) the voltage of the second node N2 once more in synchronization with the falling time T3 of the second scan signal SC2(*n*) after the sampling period P3. Thus, by including the second capacitor C2, the display apparatus according to the present disclosure can drop the voltage V_N2 of the second node N2 to the threshold voltage Vth or lower of the light emitting device LED and realize deep black, while securing a data voltage margin effectively.

Figure 4D:
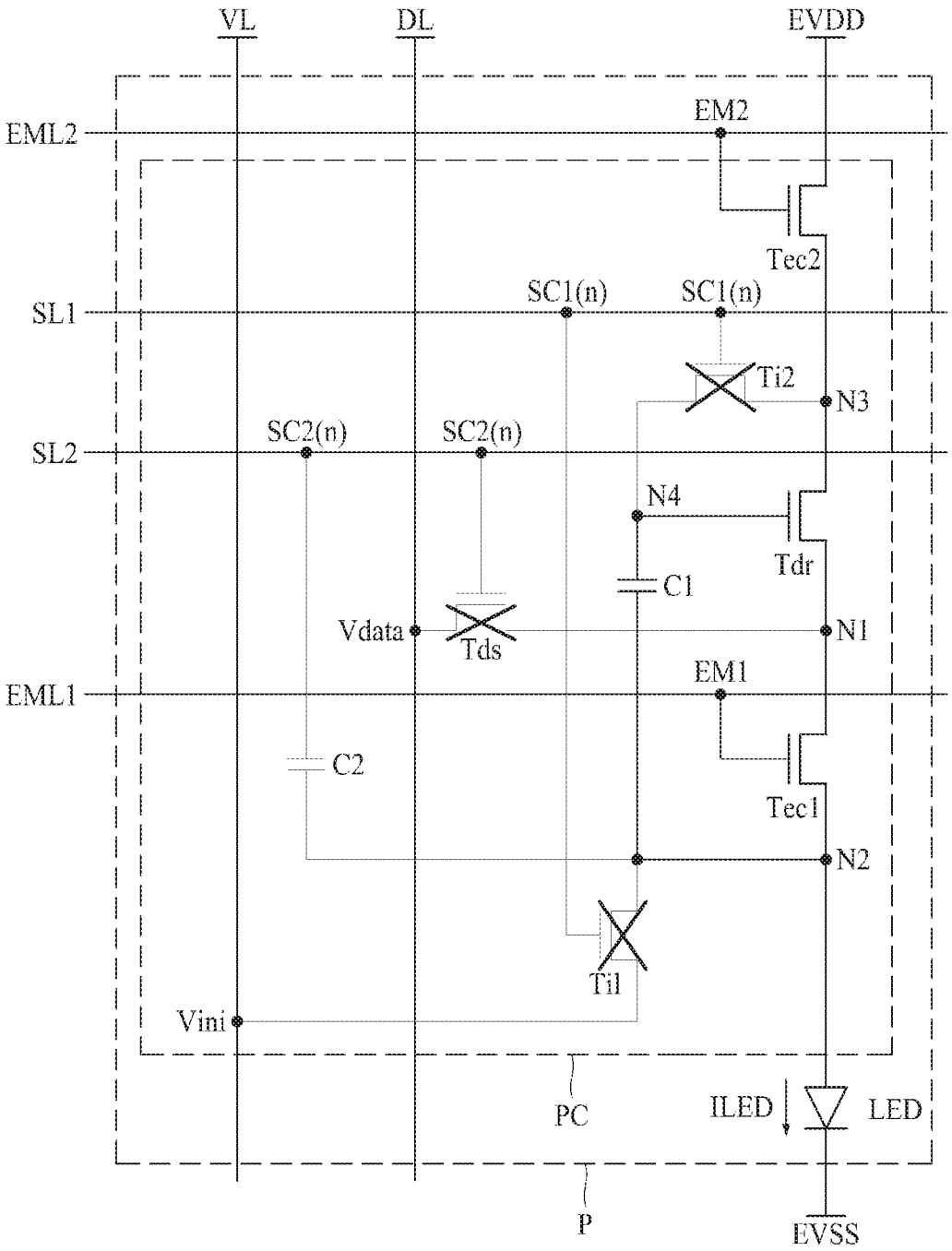

In FIG. 4D, the first light emitting control transistor Tec1 can be turned on during the emission period P4 on the basis of the first emission signal EM1 and provide the voltage of the first node N1 to the second node N2, and the second light emitting control transistor Tec2 can be turned on during the emission period P4 on the basis of the second emission signal EM2 and provide the driving voltage VDD to the third node N3. The fourth node N4, which is the gate electrode of the driving transistor Tdr, can have a sum voltage (Vdata+Vth) of the data voltage Vdata stored by the first capacitor C1 and the threshold voltage Vth of the driving transistor Tdr before the emission period P4 and the gate-source voltage Vgs of the driving transistor Tdr can be increased to be larger than the threshold voltage Vth so as to be turned on. Therefore, the second light emitting control transistor Tec2, the driving transistor Tdr, and the first light emitting control transistor Tec1 can be turned on during the emission period P4 and provide the driving current ILED to the light emitting device LED.

According to an example, the drain-source current Ids of the driving transistor Tdr can be provided to the light emitting device LED through the first light emitting control transistor Tec1. For example, the first light emitting control transistor Tec1 can provide the driving current ILED to the light emitting device LED on the basis of the drain-source current Ids of the driving transistor Tdr. Accordingly, the driving current ILED can be determined by the drain-source current Ids of the driving transistor Tdr. The drain-source current Ids of the driving transistor Tdr can be determined by the following equation at the moment the driving transistor Tdr is first turned on during the emission period P4.

$$Ids=k*(Vgs-Vth)\hat{}2=k*(V\text{data}+Vth-Vini-Vth)\hat{}2=k*(V\text{data}-Vini)\hat{}2$$

Here, k corresponds to a constant. For example, the driving current ILED can be determined by the data voltage Vdata and may not be affected by the threshold voltage Vth of the driving transistor Tdr. Therefore, the display apparatus according to the present disclosure internally compensates for the characteristic of the threshold voltage Vth of the driving transistor Tdr, thereby eliminating an electrical characteristic deviation of the driving transistor Tdr that occurs between the plurality of pixels to thus remove a luminance deviation between the pixels. As a result, the display apparatus according to the present disclosure can maintain luminance of the display panel to be uniform by compensating for threshold voltage characteristic of the driving transistor Tdr.

According to the present disclosure, all the transistors in the display apparatus of FIGS. 1 and 2 can be thin film transistors or other types of transistors.

Figure 5:
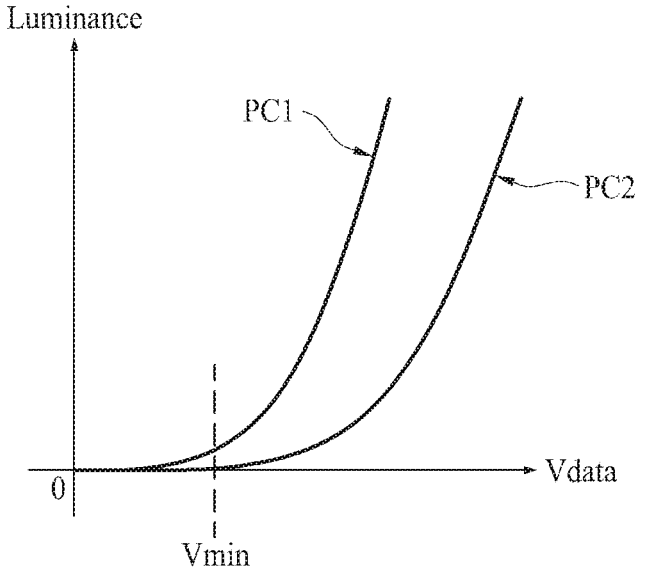
FIG. 5 is a graph illustrating brightness of the light emitting device according to a data voltage in the pixel of the display apparatus shown in FIG. 2.

FIG. 5 is a graph illustrating an example of the luminance of the light emitting device according to a data voltage in a pixel of the display apparatus shown in FIG. 2. Here, a first pixel circuit PC1 is a pixel circuit that does not include the second capacitor C2 of the present disclosure, and a second pixel circuit PC2 corresponds to or is the pixel circuit of the display apparatus according to the present disclosure. It is assumed that light emitting devices (LEDs) of the first and second pixel circuits PC1 and PC2 are the same.

Referring to FIG. 5, the first pixel circuit PC1 has a problem that the light emitting device LED slightly emits light even the data voltage Vdata has a minimum value Vmin that can be implemented in the driving circuit system, and thus, deep black cannot be realized.

In contrast, since the display apparatus according to the present disclosure includes the second capacitor C2 connected between the second scan line SL2 and the second node N2 which is the anode electrode of the light emitting device LED, the voltage V_N2 charged to the second node N2 immediately before the switching period P4 can be reduced, and when the data voltage Vdata has the minimum value Vmin that can be implemented in the driving circuit system, any light emission of the light emitting device LED can be prevented effectively. In this manner, since the display apparatus according to the present disclosure includes the second capacitor C2, when the data voltage Vdata has the predetermined minimum value, the voltage V_N2 of the second node N2 can be dropped to the threshold voltage Vth or lower of the light emitting device LED and thus deep black can be realized while securing a data voltage margin.

Therefore, in the display apparatus according to the present disclosure, when the data voltage has the predetermined minimum value, the voltage of the anode electrode of the light emitting device can be dropped to the threshold voltage or lower of the light emitting device, thereby realizing deep black, while securing the data voltage margin. Further, in the display apparatus according to the present disclosure, by dropping the voltage of the anode electrode of the light emitting device in synchronization with a falling time of the scan signal, light emission of the light emitting device can be prevented when the data voltage has the predetermined minimum value.

A display apparatus according to an embodiment of the present disclosure includes a pixel including a pixel circuit having a driving transistor and a light emitting device connected to the pixel circuit, wherein the pixel circuit includes: a driving transistor controlling a driving current flowing at the light emitting device, a data supply transistor selectively providing a data voltage to a first node which is a source electrode of the driving transistor, a first light emitting control transistor selectively connecting the first node to a second node which is an anode electrode of the light emitting device, a first light emitting control transistor selectively connecting the first node and the second node which is an anode electrode of the light emitting device, a first initialization transistor selectively providing an initialization voltage to the second node, a second light emitting control transistor selectively providing a driving voltage to a third node which is a drain electrode of the driving transistor, a second light emitting control transistor selectively providing a driving voltage to a third node which is a drain electrode of the driving transistor, a second initialization transistor selectively connecting the third node to a fourth node which is a gate electrode of the driving transistor, a first capacitor connected between the second node and the fourth node, and a second capacitor connected between the second node and a gate electrode of the data supply transistor.

According to an embodiment of the present disclosure, the pixel is driven through an initialization period, a programming period, a sampling period, and an emission period, and the first initialization transistor is turned on during the initialization period and the sampling period on the basis of a first scan signal provided from a first scan line and provides the initialization voltage to the second node.

According to an embodiment of the present disclosure, the second initialization transistor is turned on during the initialization period and the sampling period on the basis of the first scan signal and provides a voltage of the third node to the fourth node.

According to an embodiment of the present disclosure, the data supply transistor is turned on during the programming period and the sampling period on the basis of a second scan signal provided from a second scan line and provides the data voltage to the first node.

According to an embodiment of the present disclosure, the second capacitor stores a difference voltage between the second scan line and the second node.

According to an embodiment of the present disclosure, the second capacitor drops a voltage of the second node in synchronization with a falling time of the second scan signal.

According to an embodiment of the present disclosure, the second capacitor drops a voltage of the second node to a threshold voltage or lower of the light emitting device when the data voltage has a predetermined minimum value.

According to an embodiment of the present disclosure, the first light emitting control transistor is turned on during the emission period on the basis of a first emission signal provided from a first emission line and provides a voltage of the first node to the second node.

According to an embodiment of the present disclosure, the second light emitting control transistor is turned on during the initialization period and the emission period on the basis of a second emission signal provided from a second emission line and provides the driving voltage to the third node.

The above-described feature, structure, and effect of the present disclosure are included in at least one embodiment of the present disclosure, but are not limited to only one embodiment. Furthermore, the feature, structure, and effect described in at least one embodiment of the present disclosure can be implemented through combination or modification of other embodiments by those skilled in the art. Therefore, content associated with the combination and modification should be construed as being within the scope of the present disclosure.

It will be apparent to those skilled in the art that various modifications and variations can be made in the present disclosure without departing from the spirit or scope of the disclosures. Thus, it is intended that the present disclosure covers the modifications and variations of this disclosure provided they come within the scope of the appended claims and their equivalents.

What is claimed is:

1. A display apparatus comprising:

a display panel including a plurality of pixels configured to display an image, each of at least one of the plurality of pixels including a pixel circuit and a light emitting device connected to the pixel circuit, wherein the pixel circuit includes:

a driving transistor controlling a driving current flowing at the light emitting device;

a data supply transistor selectively providing a data voltage to a first node which is at a source electrode of the driving transistor;

a first light emitting control transistor selectively connecting the first node to a second node which is at an electrode of the light emitting device;

a first capacitor connected between the second node and a fourth node which is at a gate electrode of the driving transistor; and a second capacitor connected between the second node and a gate electrode of the data supply transistor.

2. The display apparatus of claim 1, wherein the second capacitor drops a voltage of the second node in synchronization with a falling time of a second scan signal supplied to the data supply transistor.

3. The display apparatus of claim 1, wherein the pixel circuit drops a voltage of the second node in synchronization with a falling time of a first scan signal supplied to an initialization transistor connected to the fourth node.

4. The display apparatus of claim 1, wherein during each of an initialization period and a sampling period, the pixel circuit drops a voltage of the second node in synchronization with a falling time of a first scan signal supplied to an initialization transistor connected to the fourth node.

5. The display apparatus of claim 1, wherein the pixel circuit further includes:

a first light emitting control transistor selectively connecting the first node and the second node; and a first initialization transistor selectively providing an initialization voltage to the second node.

6. The display apparatus of claim 5, wherein the pixel circuit further includes:

a second light emitting control transistor selectively providing a driving voltage to a third node which is at a drain electrode of the driving transistor; and a second initialization transistor selectively connecting the third node to the fourth node.

7. The display apparatus of claim 6, wherein the each of at least one of the plurality of pixels is driven through an initialization period, a programming period, a sampling period, and an emission period, and the first initialization transistor is turned on during the initialization period and the sampling period based on a first scan signal provided from a first scan line, and provides the initialization voltage to the second node.

8. The display apparatus of claim 7, wherein the second initialization transistor is turned on during the initialization period and the sampling period based on the first scan signal, and provides a voltage of the third node to the fourth node.

9. The display apparatus of claim 7, wherein the data supply transistor is turned on during the programming period and the sampling period based on a second scan signal provided from a second scan line, and provides the data voltage to the first node.

10. The display apparatus of claim 9, wherein the second capacitor stores a difference voltage between the second scan line and the second node.

11. The display apparatus of claim 9, wherein the second capacitor drops a voltage of the second node in synchronization with a falling time of the second scan signal.

12. The display apparatus of claim 9, wherein the second capacitor drops a voltage of the second node to a threshold voltage or lower of the light emitting device when the data voltage corresponds to a predetermined minimum value.

13. The display apparatus of claim 7, wherein the first light emitting control transistor is turned on during the emission period based on a first emission signal provided from a first emission line, and provides a voltage of the first node to the second node.

14. The display apparatus of claim 7, wherein the second light emitting control transistor is turned on during the initialization period and the emission period based on a second emission signal provided from a second emission line, and provides the driving voltage to the third node.

15. A pixel circuit for driving an organic light emitting diode in a pixel of a display device, the pixel circuit comprising:

a driving transistor configured to supply a driving current to the organic light emitting diode;

a data supply transistor configured to selectively provide a data voltage to a first node which is at a source electrode of the driving transistor;

a first light emitting control transistor configured to selectively connect the first node to a second node which is at an electrode of the organic light emitting diode; and a second capacitor connected between the second node and a gate electrode of the data supply transistor, wherein the second capacitor drops a voltage of the second node in synchronization with a falling time of a second scan signal supplied to the data supply transistor.

16. The pixel circuit of claim 15, further comprising:

a first capacitor connected between the second node and a fourth node which is at a gate electrode of the driving transistor, wherein the pixel circuit drops a voltage of the second node in synchronization with a falling time of a first scan signal supplied to a first initialization transistor connected to the fourth node.

17. The pixel circuit of claim 16, further comprising:

a first light emitting control transistor selectively connecting the first node and the second node; and the first initialization transistor selectively providing an initialization voltage to the second node.

18. The pixel circuit of claim 17, further comprising:

a second light emitting control transistor selectively providing a driving voltage to a third node which is at a drain electrode of the driving transistor; and a second initialization transistor selectively connecting the third node to the fourth node.

19. The pixel circuit of claim 16, wherein during each of an initialization period and a sampling period, the pixel circuit drops a voltage of the second node in synchronization with a falling time of the first scan signal.

20. The pixel circuit of claim 15, wherein the second capacitor further drops the voltage of the second node to a threshold voltage or lower of the organic light emitting diode when the data voltage corresponds to a predetermined minimum value.

* * * * *